US007922509B2

(12) United States Patent
Weber et al.

(10) Patent No.: US 7,922,509 B2
(45) Date of Patent: Apr. 12, 2011

(54) SURFACE MOUNT ELECTRICAL CONNECTOR HAVING INSULATED PIN

(75) Inventors: Ronald Martin Weber, Annville, PA (US); James John Gula, Harrisburg, PA (US); Nazareth Eppley, Enola, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/818,808

(22) Filed: Jun. 15, 2007

(65) Prior Publication Data

US 2008/0311767 A1 Dec. 18, 2008

(51) Int. Cl.
*H01R 27/00* (2006.01)

(52) U.S. Cl. ..... 439/221; 439/78; 439/83

(58) Field of Classification Search ..... 439/83, 439/78, 82, 217, 221, 224, 876
See application file for complete search history.

(56) References Cited

U.S. PATENT DOCUMENTS

| | | | | |
|---|---|---|---|---|
| 5,169,322 | A * | 12/1992 | Frantz et al. | 439/82 |
| 5,825,633 | A * | 10/1998 | Bujalski et al. | 439/82 |
| 6,224,399 | B1 * | 5/2001 | Yacoub | 439/83 |
| 6,951,467 | B1 * | 10/2005 | Hansen | 439/82 |
| 2004/0102065 | A1 | 5/2004 | Obikane et al. | |

FOREIGN PATENT DOCUMENTS

| | | |
|---|---|---|
| DE | 102 49 575 (B3) | 2/2004 |
| EP | 0 135 988 B1 | 3/1988 |
| EP | 0 747 998 | 12/1996 |
| GB | 1 591 574 | 6/1981 |

* cited by examiner

*Primary Examiner* — Felix O Figueroa

(57) ABSTRACT

A surface mount header is shown which may be mounted to a surface of a printed circuit board, where pins project away from the board. Alternatively, the surface mount header may be connected to a surface of a printed circuit board with the pins projecting downwardly through an opening in the board. Insulative sleeves surround the pins in order to protect the pins from contact with conductive paths within the board.

19 Claims, 4 Drawing Sheets

SURFACE MOUNT ELECTRICAL CONNECTOR HAVING INSULATED PIN

FIELD OF THE INVENTION

The invention relates to an electrical connector for surface mounting to a printed circuit board in multiple configurations.

BACKGROUND OF THE INVENTION

Multiple different configurations of circuit boards exist in electronic packaging, along with the corresponding electrical connection technology. Some circuit boards provide for an insulated carrier having traces along one or more of the surfaces, for example top or bottom, and electrical connectors may be mounted thereto in electrical connection with these traces. Many different component mounting methods exist, for example through-hole connection or surface mount connection.

Other types of printed boards exist which carry power through the board or provide a thermally dissipative path through the board. In one example, aluminum cladding is provided with an insulative overlay, and then circuit traces are provided on the insulative overlay, for example, through an additive or subtractive plating process. In such an architecture, components are typically surface mounted to the conductive traces top of the board. In the case of a connector header, the mating pins normally extend from the top of the board. It would be advantageous to allow for surface mount header placement yet project the header pins through the board and through the aluminum cladding to allow a connector to mate on the underside of the board. Further, a single header could be dual-configured to allow placement as a conventional header on top of the board or placed such that the pins project downwardly through the board.

SUMMARY

The objects of the invention have been accomplished by providing an electrical connector having alternative mounting arrangements, comprising an electrical connector housing, having a housing body portion. A plurality of electrical contacts, comprised of pins and electrical connection devices are adapted for mating engagement with a plurality of electrical circuit board traces. The electrical connection devices are connectable to a circuit board in any one of a plurality of configurations, where the plurality of configurations include a first configuration where the electrical connection devices are surface mounted to a first surface of a circuit board with the pins projecting away from the board; and a second configuration wherein said electrical connection devices are surface mounted to first surface of the circuit board, and said pins project through the circuit board.

In another embodiment, an electrical connector comprises an electrical connector housing having a housing body portion, and at least one electrical contact, comprised of a pin and an electrical connection device adapted for surface mount engagement with at least one electrical circuit board trace. An insulative sleeve surrounds the pin, whereby the electrical connection device is adapted for surface mounting to a surface of a circuit board, and with the pins projecting through a through opening of the circuit board, and with the insulative sleeve at least partly positioned in the through opening in the board.

In yet another embodiment, an electrical connector comprises an electrical connector housing body portion and at least one electrical contact, comprised of a pin and an electrical connection device adapted for surface mount engagement with at least one electrical circuit board trace, the electrical connection device is comprised of first and second contact surfaces, the first contact surface being positioned in a plane spaced from the second contact surface.

BRIEF DESCRIPTION OF THE DRAWINGS

The invention will now be described by way of reference to the drawings, where.

DETAILED DESCRIPTION OF THE PREFERRED EMBODIMENTS

Figure 2:
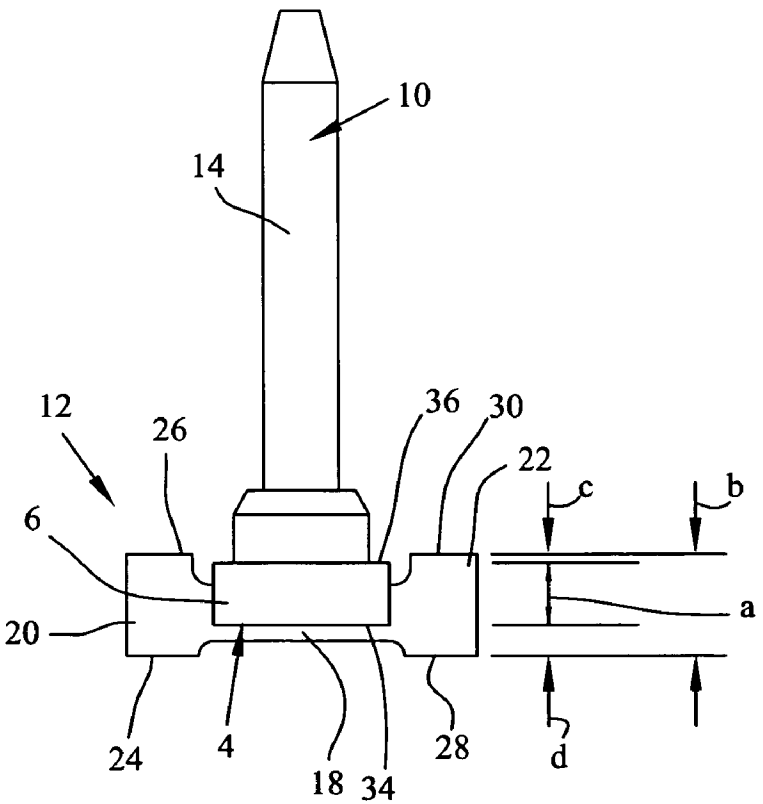
FIG. 2 shows an end view of the surface mount header of FIG. 1.
Figure 1:
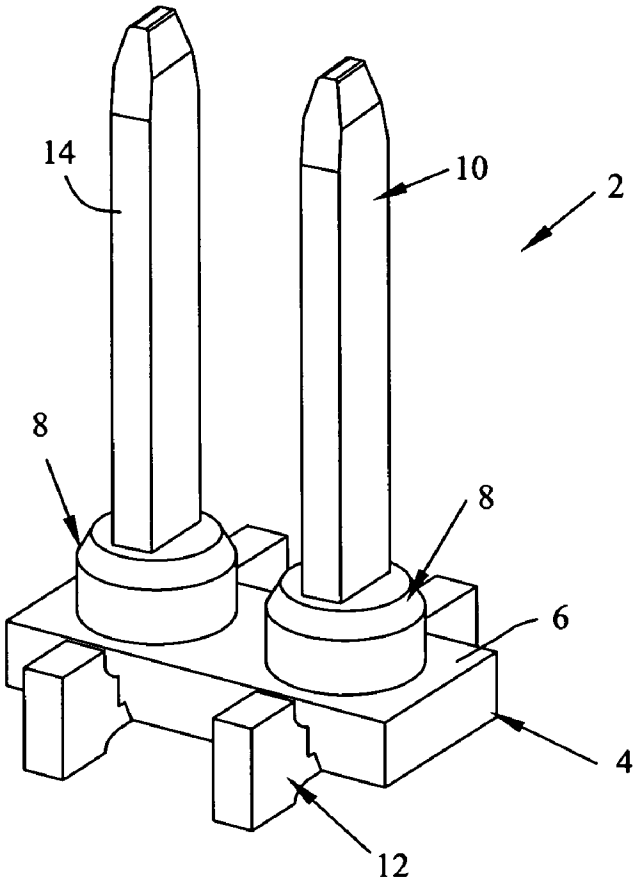
FIG. 1 is a front perspective view of the surface mount header.

With reference first to FIG. 1, an electrical connector is shown in the form of a surface mount header at 2 which includes a housing 4 comprised of a housing body portion 6 and insulative sleeves 8. Surface mount header 2 further includes electrical contacts 10 having electrical connection devices 12 integral to pins 14. With reference now to FIG. 2, contacts 10 will be described in greater detail.

Contact 10 is shown as a T-shaped member where pins 14 upstand from a transverse portion 18 with a contact member 20 positioned on one side of transverse portion 18 and a contact member 22 positioned on the opposite side of transverse portion 18. Contact member 20 includes a contact surface 24 and an oppositely directed contact surface 26. In a like manner, contact 22 includes a contact surface 28 and an oppositely directed contact surface 30. Contacts 10 could be comprised of any typical conductive material such as brass, a copper alloy, bronze, phosphor bronze, beryllium copper, gold plated contacts, and the like.

With reference still to FIG. 2, housing body portion 6 is shown overmolded over transverse portion 18 to retain contacts 10 to housing 4. It should be appreciated that apertures (not shown) could be positioned in transverse portion 18 to receive over-mold material from housing 4 to better retain contacts 10 to housing 4. Alternatively, housing body portion 6 could totally encapsulate transverse portion 18 to increase the retention of contacts 10 to housing 4. Housing body could also be formed of an insulative member with the contacts press fit in place.

With reference still to FIG. 2, housing body portion 6 has a lower surface 34 and an oppositely facing upper surface 36. As shown, surfaces 34 and 36 are the extreme surfaces of the housing body portion. Contact surfaces 28, 30 have a distance between them which is greater than the distance between the surfaces 34, 36. As shown in FIG. 2, the distance between surfaces 34, 36 of housing body portion 6 is shown as "a"; the distance between contact surfaces 28, 30 is shown as "b"; the difference between contact surface 30 and surface 36 of housing body portion 6 is shown as "c"; and the difference between contact surface 28 and surface 34 of housing body portion 6 is shown as "d".

Figure 3:
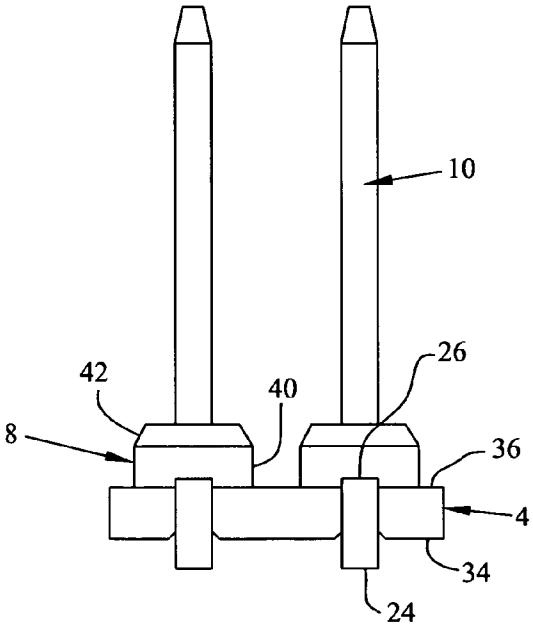
FIG. 3 shows a side view of the surface mount header of FIG. 1.

Finally, with respect to FIG. 3, insulative sleeves 8 are shown which include a cylindrical portion 40 and a frusto-conical portion 42. While the preferred embodiment of the surface mount header 2 has insulative sleeves 8 integrally molded to the housing body portion 6, other versions could have sleeves which are independent from housing body portion 6. It should also be appreciated that the housing 4 and/or sleeves could be comprised of any non-conductive material such as a phenolic, ceramic, or thermoplastic. However a moldable plastic material that is suitable to withstand the reflow soldering process would normally be utilized.

Figure 4:
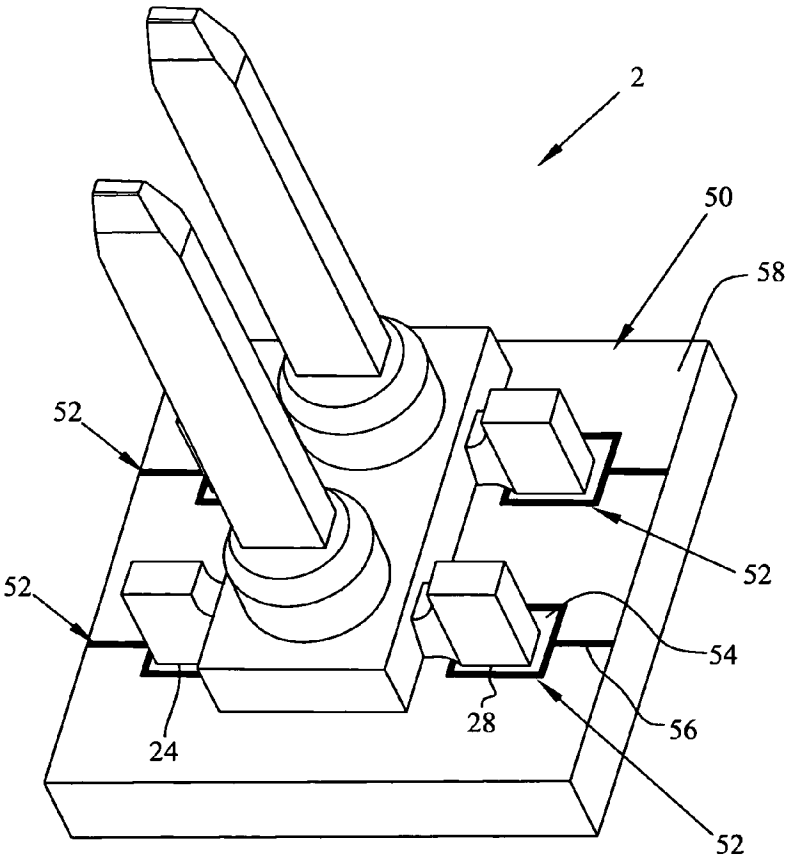
FIG. 4 shows the surface mount header of FIG. 1 mounted to a top surface of a printed circuit board.
Figure 6:
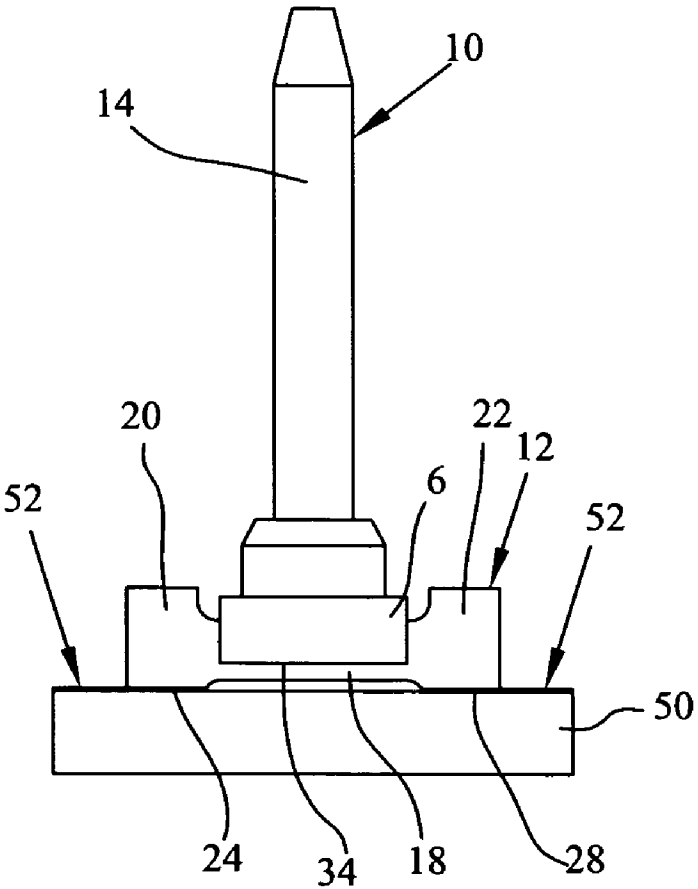
FIG. 6 shows an end view of the surface mount header mounted to a top surface of a printed circuit board.
Figure 5:
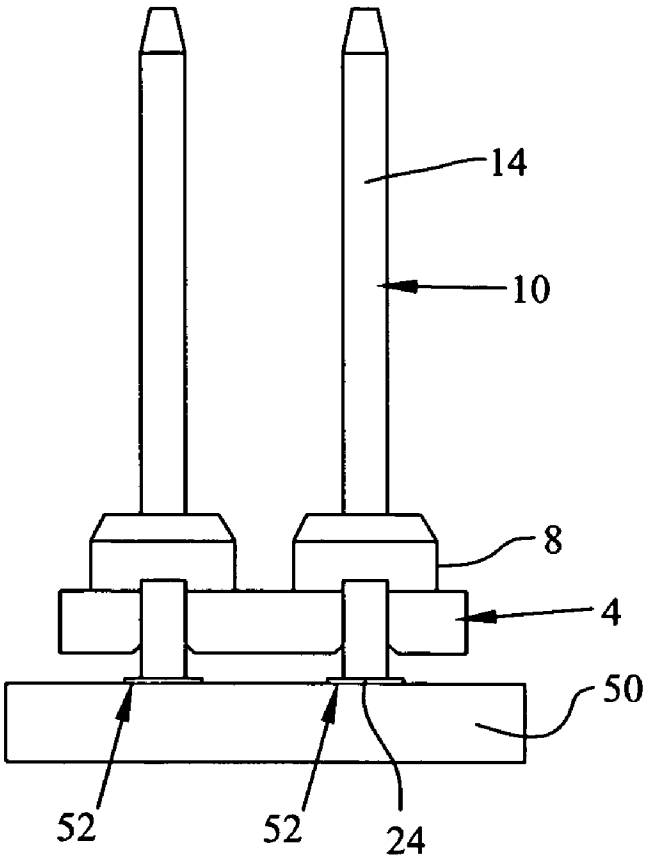
FIG. 5 shows a side view of the surface mount header mounted to a top surface of a printed circuit board.
Figure 8:
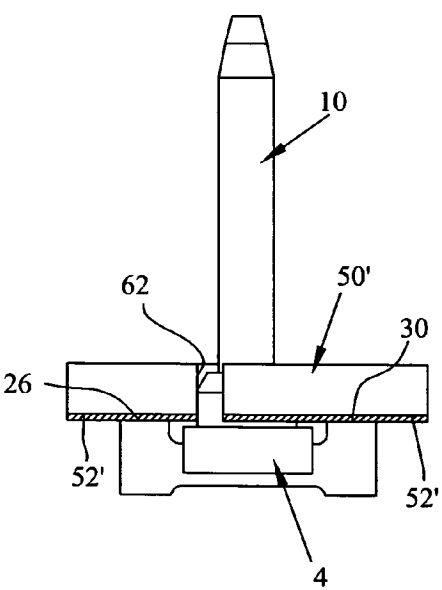
FIG. 8 shows an end view of the embodiment of FIG. 7.
Figure 9:
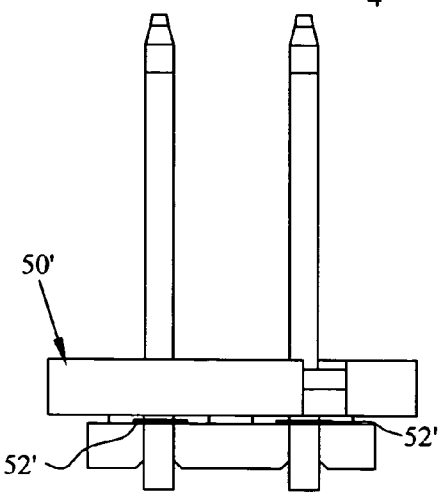
FIG. 9 shows a side view of the embodiment of FIG. 7.

With reference now to FIG. 4, surface mount header 2 is shown electrically connected to a printed circuit board 50 in a first configuration. Circuit board 50 is comprised of printed circuit traces 52 having a pad portion 54 and a trace portion 56, all of which is positioned on an insulative carrier material 58 such as a plastic or phenolic material. As shown in FIGS. 5 and 6, contact surfaces 24, 28 are shown connected to electrical circuit traces 52. Due to the configuration mentioned above, the transverse portion 18 and the surface 34 of housing body portion 6 are spaced away from the surface of the printed circuit board. That is, as the surface 34 of the housing body portion 6 is spaced a distance d from the contact surfaces 24, 28, neither the housing body portion 6 nor the transverse portion 18 will interfere with the board 50, nor with a reflow soldering process.

Figure 7:
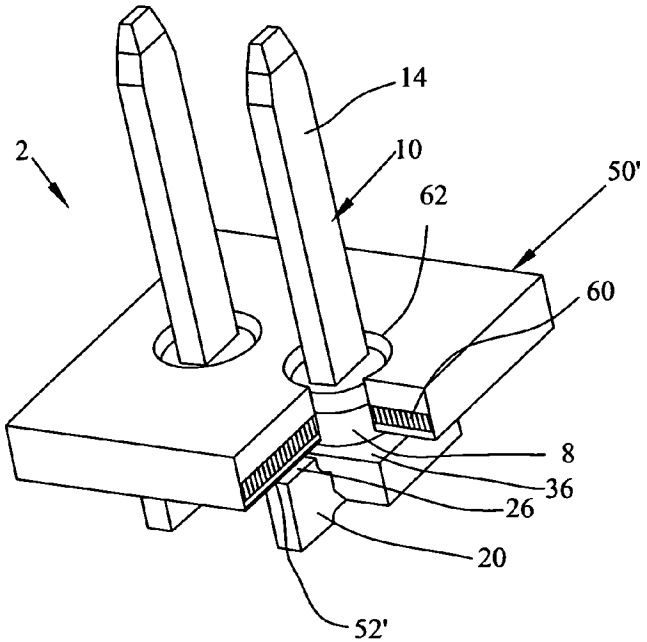
FIG. 7 shows a top perspective view showing the surface mount header of FIG. 1 mounted to a top surface of a printed circuit board with pins protruding through the bottom.

With reference now to FIG. 7, surface mount header 2 could alternatively be configured as connected to a printed circuit board 50' where printed circuit board 50' is substantially similar to that shown as printed circuit board 50, however, printed circuit board 50' includes an aluminum cladding shown at 60 for thermal dissipation of heat through the board. Circuit board 50' would include electrical circuit traces 52' substantially as shown at 52 in FIG. 4. In this embodiment, printed circuit board 50' would include openings 62 through the board 50' and through the aluminum cladding 60 and surface mount header 2 would project through the board and insulative sleeves 8 would insulate contacts 10 and more particularly pins 14 from the aluminum clad layer 60. It should be appreciated that frusto-conical portion 42 (FIG. 3) will help position the sleeves within openings 62 and that the sleeves 40 (FIG. 3) will be designed for slight interference fit with the openings 62.

Thus the surface mount header 2 could be position as shown in FIG. 7, and retained to printed circuit board 50' prior to and during the surface mount soldering process by way of the interference fit between the sleeves 8 and the openings 62. Due to the configuration mentioned above, the surface 36 of housing body portion 6 is spaced away from the surface of the printed circuit board. That is, as the surface 36 of the housing body portion 6 is spaced a distance c from the contact surfaces 26, 30, the housing body portion 6 will not interfere with the board 50, nor with a reflow soldering process.

It should also be appreciated that the Figures herein show the surface mount header 2 in certain configurations, that oppositely directed configurations are entirely anticipated herein. More specifically, FIG. 4 shows surface mount header 2 standing upwardly, but it is also anticipated that surface mount header may also project away from board 50, but in an inverted fashion. Likewise, FIG. 7 shows surface mount header attached to a upper surface of board 50, and the pins 14 extending downwardly through opening 62. However, it is entirely anticipated that this configuration may too be inverted, such that surface mount header is attached to what is then the top surface, and where pins 14 project downwardly through opening 62. Thus any reference to top, bottom, upper or lower herein, and the like, is only for the purpose of relative description and should not be interpreted to limit the claims.

It should also be appreciated that multiple connections of different configurations could be made on the same board. For example, multiple connections such as that shown in 4, and multiple connections, such as that shown in FIG. 7, can be mounted to the same board. Further, as the pins 14 herein are shown as straight, it should be appreciated that right angle versions of pins are also usable, where the pins are insertable into apertures 62, and the entire header is rotated into position, such that the ending configuration of the pin ends, would be parallel to the plane of the board.

What is claimed is:

1. An electrical connector, comprising:

an electrical connector housing body portion;

a plurality of substantially flat electrical contacts, each being comprised of a contact portion formed by a single pin and an electrical connection device adapted for surface mount soldering engagement with at least one electrical circuit board trace, each electrical connection device being comprised of first and second surface mount soldering contact surfaces on a contact member where the electrical connection devices are substantially the same width as the corresponding contact portions, and the plurality of electrical contacts are held in laterally aligned position by the housing body portion, the contact member being dimensioned with a fixed thickness between the first and second contact surfaces where the fixed thickness is greater than a distance between extreme surfaces of the housing body portion the first contact surfaces being positioned in a plane spaced from said second contact surfaces, the electrical connection devices being alternatively connectable to either the first or second contact surfaces.

2. The electrical connector of claim 1, wherein said first contact surface is mounted in a plane spaced from said electrical connector housing body portion.

3. The electrical connector of claim 1, wherein said second contact surface is mounted in a plane spaced from said electrical connector housing body portion.

4. The electrical connector of claim 1, further comprising an insulative sleeve surrounding said pin, whereby said electrical connection device is adapted for surface mounting to a surface of a circuit board, with said pins projecting through the circuit board, with said insulative sleeve at least partly positioned in a through opening in the board.

5. The electrical connector of claim 4, wherein said sleeve is frusto-conically shaped, tapering inwardly towards an end of said pin.

6. An electrical connector having alternative mounting arrangements, comprising:

an electrical connector housing, having a housing body portion;

a plurality of electrical contacts positioned in the housing body portion, whereby the plurality of electrical contacts are directly attached to the housing body portion with each electrical contact being comprised of at least one pin and at least one electrical connection device, each electrical contact being flat and defining two major parallel surfaces, each electrical contact further comprising a contact portion extending from the electrical connector housing, with the plurality of contacts lying in parallel planes, whereby the plurality of electrical contacts are adapted for mating engagement with a plurality of electrical circuit board traces, wherein each electrical connection device is comprised of first and second contact surfaces defined on opposite ends of the contact portion and spaced apart by a thickness greater than a thickness of the electrical connector housing;

said electrical connection devices being connectable to a circuit board in a plurality of configurations, where the circuit board has first and second oppositely facing surfaces wherein said plurality of configurations include:

a first configuration wherein the first contact surface of said electrical connection devices is surface mounted to a first surface of a circuit board with the pins projecting away from the board; and a second configuration wherein the second contact surface of said electrical connection devices is surface mounted to a first surface of the circuit board, and said pins project through the circuit board and are electrically isolated from the second surface.

7. The electrical connector of claim 6, wherein the first contact surface is defined by a stamped edge positioned in a plane spaced from said second contact surface.

8. The electrical connector of claim 6, wherein said first contact surface is mounted in a plane spaced from said electrical connector housing body portion.

9. The electrical connector of claim 8, wherein said second contact surface is defined by a stamped edge mounted in a plane spaced from said electrical connector housing body portion.

10. The electrical connector of claim 6, further comprising an insulative sleeve surrounding said pin, whereby said electrical connection device is adapted for surface mounting to the first surface of the circuit board, and said pins project through the circuit board beyond a second surface, and said insulative sleeve at least partly positioned in a through opening in the board between the first and second surfaces.

11. The electrical connector of claim 10, wherein said sleeve is integral with said electrical connector housing body portion.

12. The electrical connector of claim 11, wherein said sleeve is frusto-conically shaped, tapering inwardly towards an end of said pin.

13. An electrical connector, comprising:

an electrical connector housing having a housing body portion;

a plurality of electrical contacts cooperating together with the housing body portion such that the electrical contacts are attached to said housing body portion, and each electrical contact being comprised of a pin and an electrical connection device having at least one contact portion adapted for surface mount engagement with at least one electrical circuit board trace, wherein each electrical connection device is comprised of first and second contact surfaces defined on opposite ends of the contact portion and spaced apart by a thickness greater than a thickness of the electrical connector housing;

an electrically insulative sleeve surrounding said pin, whereby said electrical connection device is adapted for surface mounting to a surface of a circuit board, and with said pins projecting through a through opening of the circuit board, with said electrically insulative sleeve at least partly positioned in the through opening in the board, with the pins fixed to the electrically insulative sleeve, and the electrically insulative sleeve profiled for an interference fit within the through opening.

14. The electrical connector of claim 13, wherein said sleeve is integral with said electrical connector housing body portion, and said housing body portion is overmolded about said plurality of electrical contacts, the electrical contacts being encapsulated within the housing body portion.

15. The electrical connector of claim 14, wherein said sleeve is frusto-conically shaped, tapering inwardly towards an end of said pin.

16. The electrical connector of claim 13, wherein each electrical connection device is comprised of first and second contact surfaces, the first contact surface being positioned in a plane spaced from said second contact surface.

17. The electrical connector of claim 16, wherein said first contact surface is mounted in a plane spaced from said electrical connector housing body portion.

18. The electrical connector of claim 17, wherein said second contact surface is mounted in a plane spaced from said electrical connector housing body portion.

19. The electrical connector of claim 13, wherein said electrical connection devices are also connectable to a circuit board in a configuration wherein said electrical connection devices are surface mounted to a surface of a circuit board with said pins projected away from the surface.

* * * * *